US006419219B2

(12) United States Patent
Schaefer et al.

(10) Patent No.: US 6,419,219 B2
(45) Date of Patent: Jul. 16, 2002

(54) SIGNATURE DELIVERY APPARATUS INCLUDING TWO ROTATING BUCKETS

(75) Inventors: Karl P. Schaefer, Brookfield; Ingermar S. d'Agrella, Sussex; Richard J. Fox, Menomonee Falls, all of WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/835,421

(22) Filed: Apr. 16, 2001

Related U.S. Application Data

(63) Continuation-in-part of application No. 09/291,145, filed on Apr. 12, 1999, now Pat. No. 6,247,692.

(51) Int. Cl.[7] ..... B65H 39/00; B65H 29/30

(52) U.S. Cl. ..... 270/60; 270/52.01; 271/315

(58) Field of Search ..... 270/52.01, 58.01, 270/60; 271/182, 187, 264, 275, 302, 303, 315

(56) References Cited

U.S. PATENT DOCUMENTS

| | | | | |
|---|---|---|---|---|
| 3,762,697 A | | 10/1973 | Boiza-Schunemann | |
| 4,373,713 A | | 2/1983 | Loebach | |
| 4,522,387 A | | 6/1985 | Leuthold | |
| 4,593,896 A | | 6/1986 | Nakamura | |
| 4,729,282 A | | 3/1988 | Kasdorf | |
| 5,112,033 A | * | 5/1992 | Breton | 270/47 |
| 5,156,389 A | * | 10/1992 | Novick | 271/187 |
| 5,180,160 A | * | 1/1993 | Belanger et al. | 271/315 |
| 5,615,878 A | * | 4/1997 | Belanger et al. | 271/302 |
| 5,639,083 A | | 6/1997 | Doucet | |
| 5,647,586 A | * | 7/1997 | Novick et al. | 271/182 |
| 5,730,435 A | * | 3/1998 | Belanger et al. | 270/52.14 |

* cited by examiner

*Primary Examiner*—Donald P. Walsh
*Assistant Examiner*—Mark J. Beauchaine
(74) *Attorney, Agent, or Firm*—Michael Best & Friedrich LLP

(57) ABSTRACT

A delivery apparatus for sorting a single stream of signatures into two or more streams, the apparatus includes two counter-rotating bucket assemblies. Each bucket assembly includes a plurality of buckets spaced from one another along a common axis. The respective common axis of each bucket assembly is disposed parallel to the common axis of the other. Each of the buckets of one of the bucket assemblies is disposed adjacent to and in a respective common plane with a respective one of the buckets of the other of the bucket assemblies. Further, each of the buckets includes a plurality of blades, the tips of the blades of each bucket defining a circumference. A respective circumference of one bucket overlaps the circumference of the other bucket disposed in the common plane. Two neighboring blades have respective surfaces defining a slot therebetween. Each slot includes a first generally wedge-shaped portion defined by a first planar surface and a second planar surface disposed at a first angle from the first planar surface, and a second generally wedge-shaped portion defined by a third planar surface and a fourth planar surface disposed at a second angle from the third planar surface. The second angle is smaller than the first angle.

22 Claims, 4 Drawing Sheets

38
50
39
64
66
62
36
60

SIGNATURE DELIVERY APPARATUS INCLUDING TWO ROTATING BUCKETS

The present application is a continuation-in-part of U.S. patent application Ser. No. 09/291,145 filed Apr. 12, 1999, now U.S. Pat. No. 6,247,692, issued Jun. 19, 2001.

FIELD OF THE INVENTION

The present invention relates to a signature delivery apparatus for a folder. In particular, the invention relates to a signature delivery apparatus including two overlapping rotating buckets which operate to feed signatures alternately to one of two paths.

BACKGROUND OF THE INVENTION

In the printing industry, a desired image is repeatedly printed on a continuous web or substrate such as paper. In a typical printing process, the continuous web is slit (in the longitudinal direction which is the direction of web movement) to produce a plurality of continuous ribbons. The ribbons are aligned one on top of the other, folded longitudinally, and then cut laterally to produce a plurality of multi-page, approximately page-length segments, each of which is termed a "signature". The term signature also encompasses a single printed sheet that has or has not been folded. Because more than one different signature can be printed at one time, it is often desirable to separate the different signatures by transporting successive signatures in different directions or paths.

One way to accomplish the sorting of a single stream of signatures is to use a diverter mechanism including a stationary diverter wedge to divert successive signatures to one of two paths. Examples of such diverter mechanisms are described in U.S. Pat. Nos. 4,373,713 and 4,729,282.

Another way to accomplish the sorting of a single stream of signatures into two or more streams is with the use of rotating buckets (also known as fans, fan wheels, paddle fans, or rotary flywheels). One known configuration for sorting signatures includes two sets of rotating buckets, wherein the two sets have outer diameters which overlap. This arrangement is disclosed in U.S. Pat. No. 5,112,033. As described therein, each set of buckets includes several identical buckets arranged at a spaced distance from one another along a common axis. Each bucket has multiple blades which define pockets or slots for receiving signatures. Each blade includes a recess so that the blades do not collide when the two sets of buckets rotate. Signature placement alternates from the slots of the right set of buckets to the slots of the left set of buckets to thereby sort the single stream of signatures into two streams.

The use of recesses in the blades as described in U.S. Pat. No. 5,112,033 has certain disadvantages. For example, a recess in the blade presents an obstacle for a signature and may interfere with the smooth entry or exit of the signature into or out of the slot. The process of removing a signature from a slot is also referred to as "stripping" the signature. Additionally, in one embodiment described in the above-referenced patent, the recess in the blade has a cover that acts like a spring. The cover can be depressed, and when the force is removed, the cover will bounce back. This cover gets depressed by the blade of the opposite bucket once per signature that is processed in the associated slot. Thus, the cover can wear out, break, orjam in the open or closed position. Also, the dust created from the cutting process can cause problems with jamming of the cover.

It is desirable to increase the operating speed of a printing press as much as possible in order to increase the printed product output. However, as the rotational speed of the buckets is increased, it is more difficult to ensure the reliable operation of the buckets while ensuring the quality of the signatures. For example, signature quality problems that can occur at higher press speeds include ink offset, dog-eared edges, and defects to both the leading and trailing edges of the signatures. These and other defects can lead to paper jams in the folder, resulting in press downtime and expense.

SUMMARY OF THE INVENTION

It is a principal object of the present invention to provide a signature delivery apparatus for a folder for sorting a single stream of signatures into two or more streams. The delivery apparatus includes two counter-rotating bucket assemblies. Each bucket assembly includes a plurality of buckets spaced from one another along a common axis. The respective common axis of each bucket assembly is disposed parallel to the common axis of the other. Each of the buckets of one of the bucket assemblies is disposed adjacent to and in a respective common plane with a respective one of the buckets of the other of the bucket assemblies. Further, each of the buckets includes a plurality of blades, the tips of the blades of each bucket defining a circumference. The respective circumference of one bucket overlaps the circumference of the other bucket disposed in the respective common plane. Two neighboring blades on a bucket have respective surfaces defining a slot therebetween. Each slot includes a first generally wedge-shaped portion defined by a first planar surface and a second planar surface disposed at a first angle from the first planar surface, and a second generally wedge-shaped portion defined by a third planar surface and a fourth planar surface disposed at a second angle from the third planar surface. The second angle is smaller than the first angle.

Also disclosed herein is an improved stripper profile which lessens the impact shock on the leading edge of the signature during signature stripping from the bucket.

Other features and advantages of the invention will become apparent to those skilled in the art upon review of the following detailed description, claims and drawings.

Figure 1:
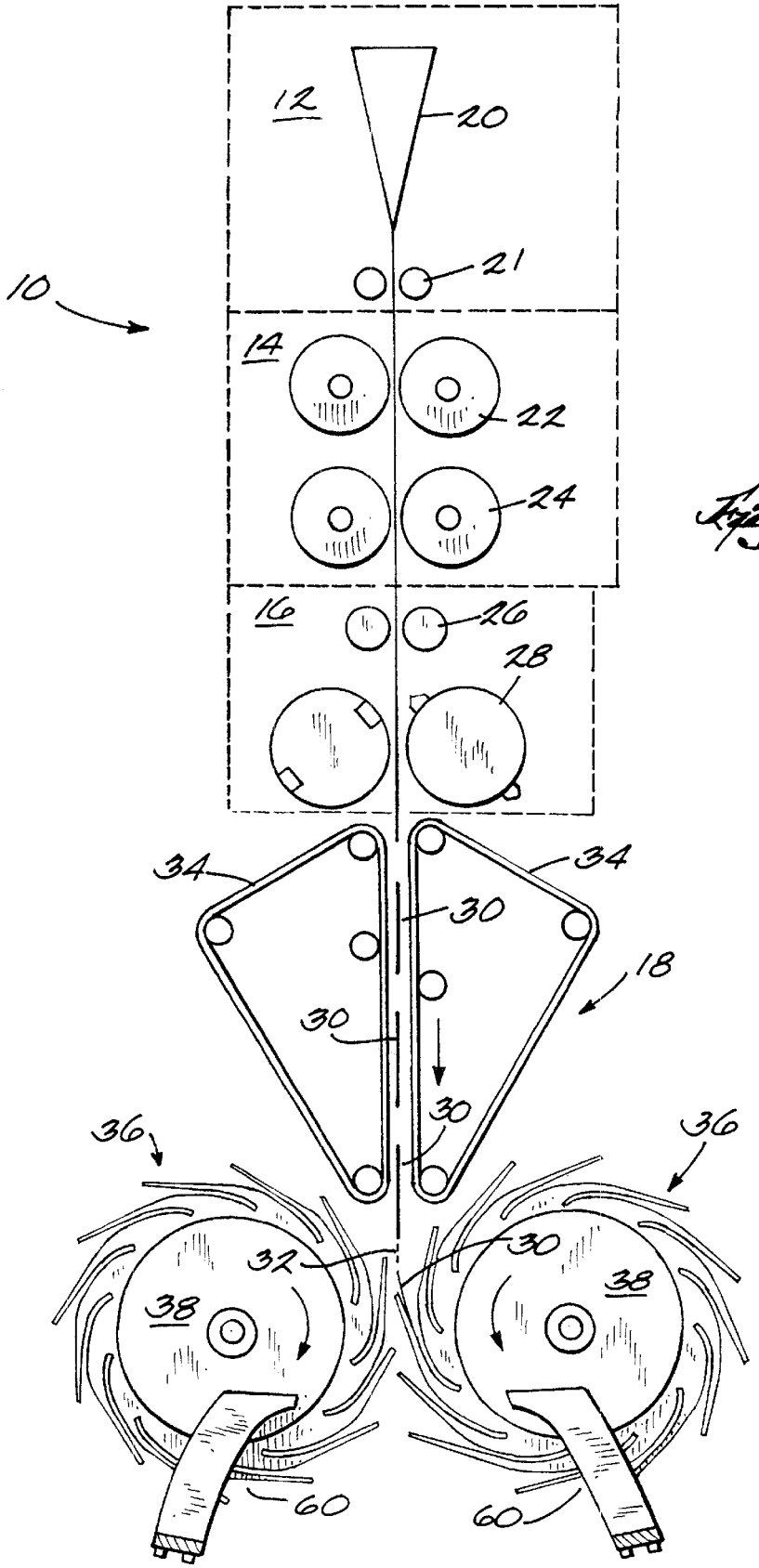
FIG. 1 is a schematic diagram of a pinless folder incorporating a delivery apparatus in accordance with the present invention.

Before one embodiment of the invention is explained in detail, it is to be understood that the invention is not limited in its application to the details of construction and the arrangement of components set forth in the following description or as illustrated in the drawings. The invention is capable of other embodiments and of being practiced or of being carried out in various ways. Also, it is to be understood that the phraseology and terminology used herein is for the purpose of description and should not be regarded as limiting.

BRIEF DESCRIPTION OF THE PREFERRED EMBODIMENT

Illustrated in FIG. 1 of the drawings is a schematic of a folder 10 which is a portion of a high speed printing press.

The folder 10 includes a forming section 12, a drive section 14, a cutting section 16, and a delivery section 18.

In particular, the forming section 12 includes a generally triangularly shaped former board 20 which receives a web of material (or several longitudinally slit sections of the web called ribbons, wherein the ribbons are typically aligned one on top of the other) and folds the same longitudinally (i.e., in the same direction as the web travels). The folded web is then fed downwardly under the influence of a pair of squeeze rolls 21 to the drive section 14. The drive section 14 includes pairs of upper and lower drive rolls, 22 and 24 respectively. These drive rolls transport the web to conditioning rolls 26 in the cutting section 16. The web then passes into engagement with a cutting device 28. The web is segmented by the cutting device 28 into a plurality of signatures 30. Suitable timing means, known to those of ordinary skill in the art, provide accurate longitudinal registration of the image on the web with respect to the cutting device 28 to ensure proper cut locations for the web segments.

Successive signatures 30 enter the delivery section 18 along a delivery path 32, aided by belts or transport tapes 34. The opposed tapes 34 are shown apart for clarity, but are actually very close together and press on each other with the signature between them. The delivery section 18 also includes stripping assemblies 60 and two bucket assemblies 36. The two bucket assemblies operate to sort the single stream of signatures into two streams and also slow down the signatures. The stripping assemblies 60 operate to remove a signature at a time from a respective bucket 38. The signature then falls upon a conveyor (not shown) where successive signatures are arranged in a shingled stream. The movement of the signatures on the shingling conveyor can be to the left or the right or out of the plane of FIG. 1.

Figure 2:
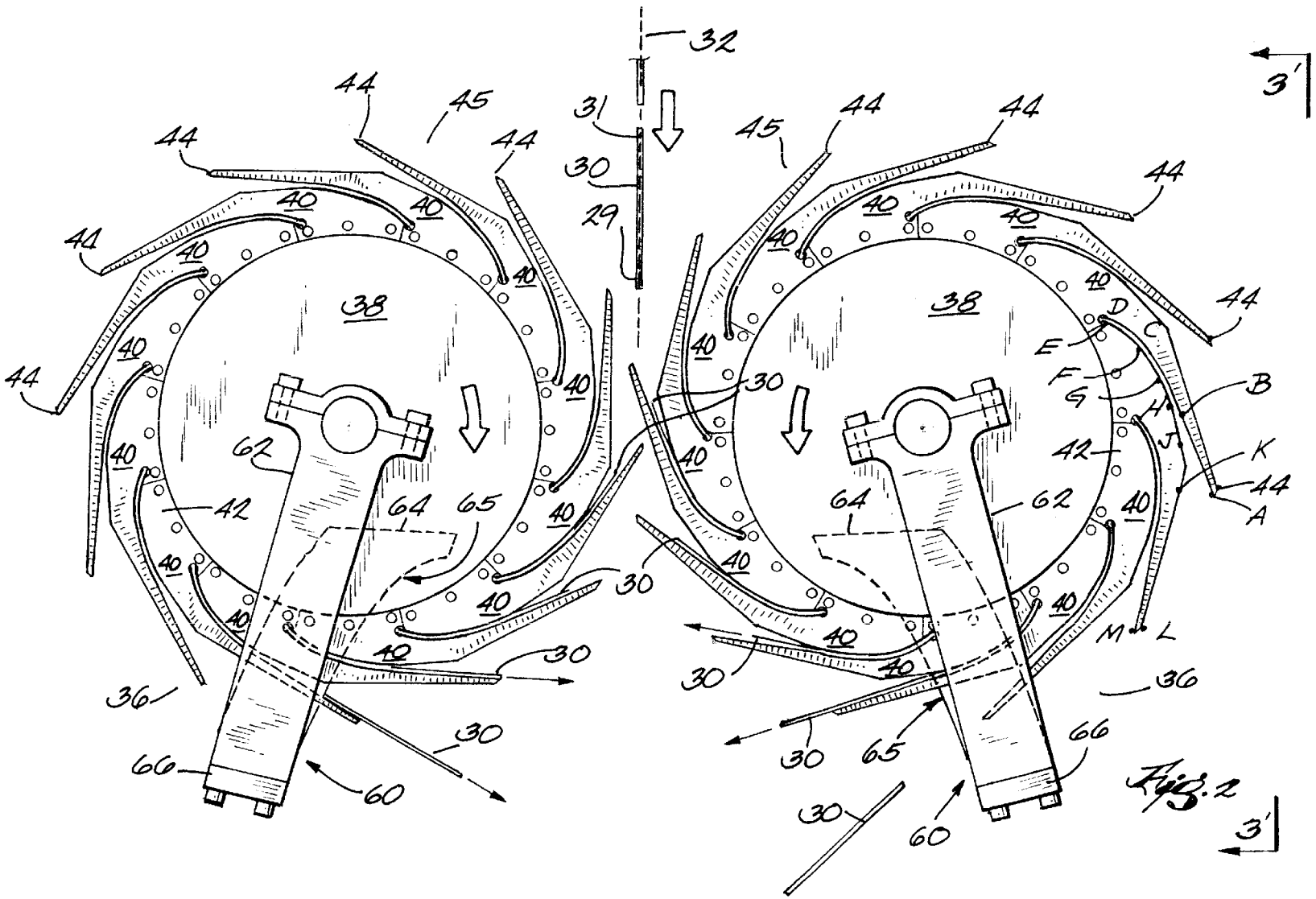
FIG. 2 is an illustration of two bucket assemblies and two stripping assemblies in accordance with the present invention.
Figure 3:
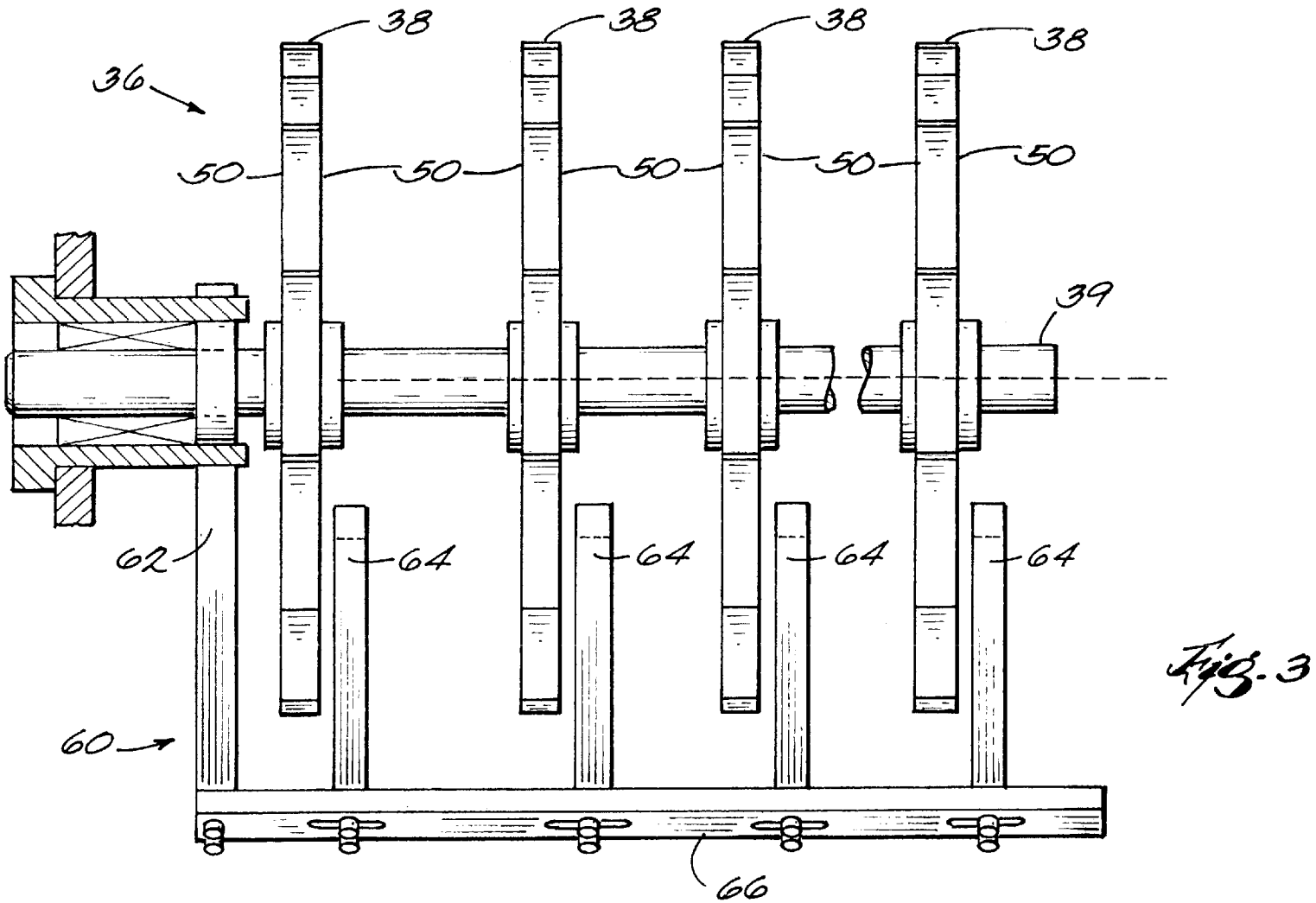
FIG. 3 is a cross-sectional view taken along line 3—3 of FIG. 2.
Figure 4:
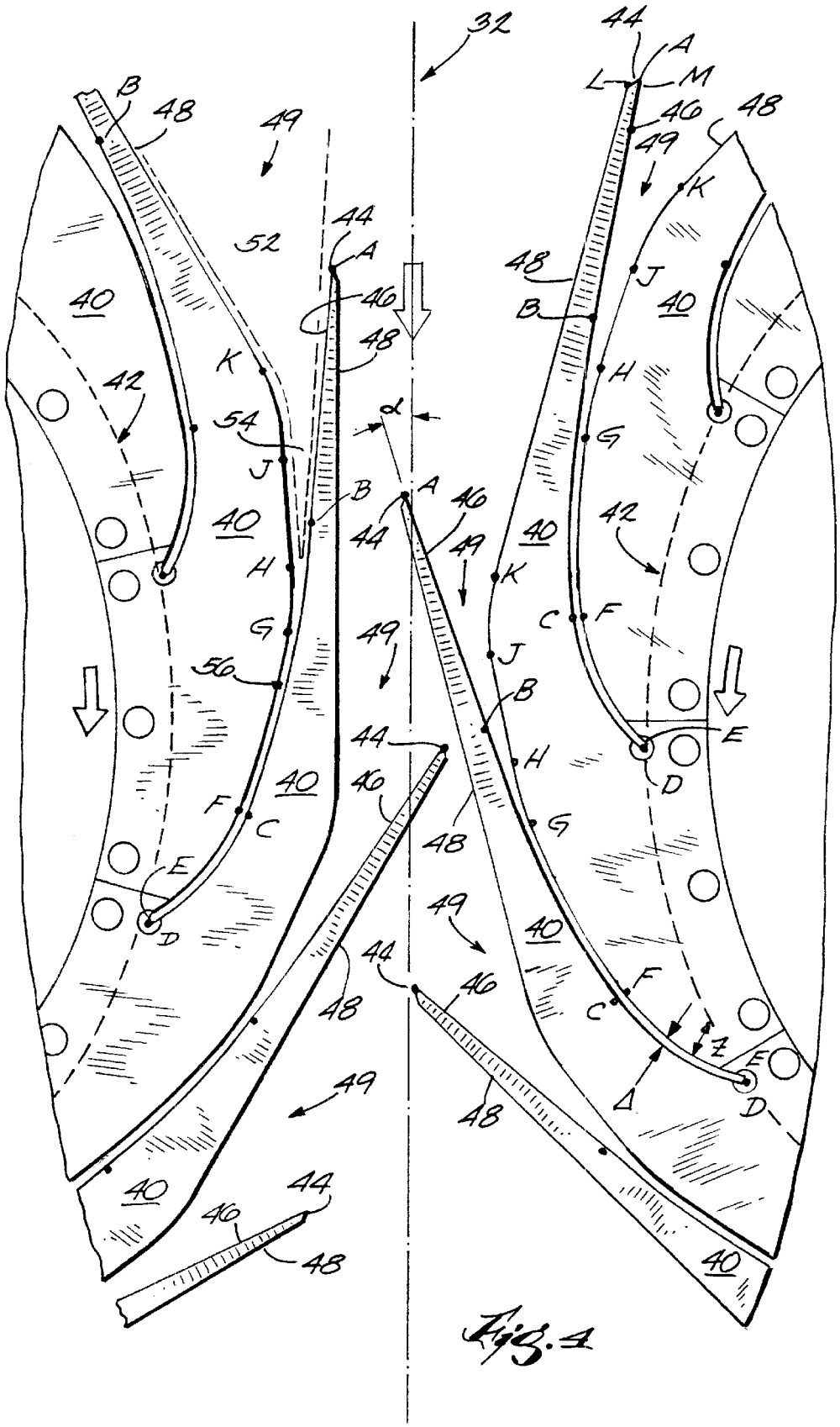
FIG. 4 is a partial illustration of two overlapping buckets showing in detail the shapes of the blades and the slots.

Referring to FIGS. 2 and 4, the configuration of each bucket assembly 36 is illustrated in detail. Although only one bucket 38 per bucket assembly 36 is shown in these figures, each bucket assembly 36 includes identical buckets 38 spaced at predetermined distances along a respective common shaft 39, as shown in FIG. 3. In both FIGS. 2 and 4, the buckets on the left rotate in a clockwise direction, and the buckets on the right rotate in a counterclockwise direction.

In the preferred embodiment, each bucket 38 includes twelve blades 40 extending outwardly from an inner circular portion 42. The tips 44 of the blades define an outer circle having an outer circumference 45. The outer circumference 45 of the left set of buckets overlaps the outer circumference 45 of the right set of buckets. In the preferred embodiment, the diameter of the outer circle is 37.5 inches and the center to center spacing of the bucket assemblies is 36 inches such that there is 1.5 inches of overlap.

The blades 40 are constructed so as to prevent collisions between blades from opposing buckets when the buckets 38 are rotating. In particular, as best seen in FIG. 4, each blade 40 includes a primary blade surface 46 and a secondary blade surface 48. The primary blade surface 46 of one blade and the secondary blade surface 48 of a successive blade together define a slot 49 for receiving signatures.

The primary blade surface is the main surface that the signature slides on as it enters the bucket slot. In particular, each primary blade surface 46 is composed of three portions AB, BC, and CD. Viewed in profile, portions AB, BC, and CD correspond to segment AB, which is a straight line, segment BC, which is an arc, and segment CD, which is also an arc. In the preferred embodiment, segment AB has a length of five inches, tangentially connected segment BC has a twenty four inch radius and a length of six inches, and tangentially connected segment CD has a 4.0 inch radius and a length of three inches. Thus, the slot 49 has a length measured along the primary blade surface 46 of fourteen inches and is intended to receive a signature that is eleven inches long. The longer slot allows room for the signature to bounce back slightly from the slot end DE, without interfering with the operation of the rotating buckets. The three inches of extra slot length also allows the signature to be completely within the slot before the signature slows down during the last three inches of travel as it approaches slot end DE.

The secondary blade surface is composed of six surface portions EF, FG, GH, HJ, JK, and KL. Again as viewed in profile, these portions include corresponding segments EF, FG, GH, HJ, JK, and KL. In particular, segment EF is an arc having a radius drawn from the same center as segment CD. Similarly, segment FG is an arc having a radius drawn from the same center as segment BC.

The slot width $\Delta$ is therefore constant in the region from E to G, and in the preferred embodiment is 0.125 inches wide. Segment GH is an arc, segment HJ is a straight line, segment JK is an arc, and segment KL is a straight line. Segments AB and KL and the area between these segments provide the necessary clearance so that an opposing bucket blade does not collide with a given bucket blade. Further in the preferred embodiment, segment EF has a 3.875 inch radius, segment FG has a 23.875 inch radius, segment GH has a four inch radius, and segment JK has a four inch radius.

At the tip 44 of a blade 40, portion LM can either be a planar surface or a convex surface that matches the circumference of the outer circle 45. The blade edges 50 (shown in FIG. 3) of the primary and secondary blade surfaces 46, 48 on both sides of the blade are rounded. The rounded edges reduce or eliminate the sharp edges that may tear or otherwise cause damage to a signature 30.

Thus, the primary blade surface 46 and the secondary blade surface 48 of a successive blade together define slots 49 for receiving signatures. As shown in FIG. 4, the slots 49 include a first wedge-shaped section 52, a second wedge-shaped section 54, and a constant width section 56. The first wedge-shaped section 52 is defined by planar surfaces partially including portions AB and KL. The second wedge-shaped section 54 is defined by curved surfaces partially including portions AB, BC and portions GH, HJ, and JK. The first wedge-shaped section 52 prevents opposing blades 40 from hitting the bucket 38 and allows clearance for the signature insertion as the bucket rotates. The second wedge-shaped section 54 functions to further channel the signature into the constant width section 56 of the slot and prevents flaring out of the leading edge of the signature which could cause dog ears on the leading edge.

The slot 49 meets a tangent to the inner circular portion 42 at an angle of approximately forty-five (45) degrees. Additionally, the slot ends, surfaces DE, are on the circumference of the inner circular portion and also have rounded edges on both front and rear. In the preferred embodiment, the diameter of the inner circular portion 42 measures twenty-seven inches. For a given rotational bucket speed, the slot ends in a bucket having a larger inner diameter travel at a higher rate of speed than do slot ends in a bucket having a smaller inner diameter. Thus, the impact force between a moving signature and the slot end is reduced the faster the slot ends travel because the speed difference between the two is reduced.

The speed of the transport tapes 34 is designed to be approximately 8 to 15% greater than the speed of the web prior to the cutting device. This speed increase creates a gap between successive signatures 30 along the delivery path 32. The size of this gap is independent of machine speed and depends only upon the speed gain of the transport tapes 34 and the signature length. The larger the speed gain of the tapes, the larger the resulting gap between signatures. This gap between successive signatures makes the diverting of signatures to alternate buckets possible.

The angular speed of each bucket is such that each bucket turns one angular slot distance (30 degrees for a bucket with 12 slots) for every two signatures fed from the cutting device 28. Each bucket turns at such an angular speed so that it receives every other signature during the diverting process. To achieve the proper speeds, the bucket shaft is driven by the printing press line shaft with the proper speed reduction to take into account the number of slots per bucket and the fact that every other signature is directed to a single bucket. A bucket having a smaller number of slots per given circumference has to turn at a faster angular speed (RPM) than one with more slots in order to receive all the signatures coming towards it.

In operation, the transport tapes 34 move the signatures 30 to a location in the vicinity of the two bucket assemblies 36 along delivery path 32, which is the centerline between the two buckets. A signature 30 strikes a primary blade surface 46 of a blade 40 momentarily disposed across the signature path in a position for receiving the signature. The tip 44 of the blade is about 0.125 to 0.250 inches across the center line 32 as the leading edge of the signature hits the surface 46. The signature strikes the surface 46 at an angle $\alpha$ (shown in FIG. 4) of approximately twenty degrees or less. The smaller the angle $\alpha$ is made, the smaller is the impact force on the leading edge 29 of the signature. The signature 30 is directed by the primary blade surface 46 into the slot 49 formed between adjacent blades. The frictional contact with the primary blade surface 46 and the ever tightening radius of curvature slows down the signature 30 as it continues in the slot 49.

The tips 44 of the next blades to cross center line 32 are tips from the opposite set of buckets 36. The left hand bucket is phased with respect to the right hand bucket such that the blades from the two set of buckets much properly without hitting each other. These tips 44 act to deflect the trailing edge 31 of the signature in order to prevent the trailing edge 31 from accidentally whipping around the tip 44 of the previous bucket blade. The end of the signature is rounded so that it does not damage the signature during this hit process. The next signature 30 is then transported by the tapes 34 into the vicinity of these tips and the signature is placed into this opposite set of blades. Thus, the signature placement into the slots alternates between the two bucket assemblies. These steps are repeated in order to place successive signatures alternately into the two bucket assemblies, to thereby separate the single stream of signatures into two streams.

In order to remove the signatures from the slots, a stripping assembly 60 is utilized, as illustrated in FIGS. 1–3. The stripping assembly 60 includes a pivot arm 62, several strippers 64, and a mounting bar 66. The pivot arm 62 is mounted to remain stationary relative to the axis of the buckets during rotation thereof, but is adjustable around the bucket axis. As the pivot arm is adjusted around the bucket axis, the position of the strippers 64 are adjusted relative to the slots. The purpose of this adjustment is so that one can adjust the amount of time between the hit at the end of the bucket slot and the subsequent hit on the stripper. The two hits should not be too close together in time because it is desirable to have two separate distinct hits to dissipate the kinetic energy instead of only one hit on the stripper. As FIG. 3 illustrates, the strippers 64 are mounted in spaced apart relation along the mounting bar 66. Each stripper 64 is spaced from a respective bucket 38. The strippers 64 are individually adjustable along the length of the mounting bar 66.

It is desirable for a signature 30 to approach the inner circular portions 42 of the buckets 38 tangentially to reduce the impact force as the signature 30 hits the inner circular portion at the slot end DE. However, for efficient signature removal by the stationary strippers, a relatively large angle is preferable because the impact force is less when the signature hits the stationary stripping assembly 60 and is ejected from the slots 49. Thus, an angle of forty-five degrees was chosen as a compromise between these two competing requirements.

As best seen in FIG. 2, each stripper 64 includes a smooth surface, depicted as curve 65, on which the leading edge 29 of a signature strikes. Ideally, the stripper curve 65 is one that decelerates a signature over as long of a time period as possible so that the impact force acting on the leading edge 29 of the signature 30 when the signature hits the stripper 64 is kept to a minimum. A smaller impact force on the stripper at a given rotational bucket speed prevents damage to the leading edge 29 of the signature 30 and allows for higher rotational bucket speeds which means faster printing press running speeds. In addition, the direction of the ejection force that pushes the signature out of the slot 49 should be in the direction of segment EG (i.e., along the slot length) rather than perpendicular to segment EG (i.e., perpendicular to the sides of the slots). An ejection force having too large of a force component perpendicular to the segment EG can damage or tear the signature 30 during the stripping process. This is especially true at slot end DE where the signature 30 first makes contact with the stripper 64 to start the stripping process. Once the signature 30 has started to move partially out of the slot 49 after the initial hit with the stripper 64 (after the leading edge 29 of the signature 30 has been pushed out by about one inch from the slot end DE), then the impact force diminishes and its direction does not have to remain parallel to the direction of the slot.

The impulse time can be increased by inclining the signature ejection force slightly away from the direction of the slot length, resulting in a small component of the signature ejection force that is perpendicular to the direction of the sides of the slot. In the preferred embodiment of the stripper 64, the curve 65 results in an impact force that is gradually increased from within 10 degrees of the direction of the slot length during the first portion of the stripping process to within 20 degrees during the end of the stripping process.

In the preferred embodiment, the stripper 64 is constructed out of a ¾ inch thick sheet of plastic such as Delrin. This material allows the leading edge of the signature to slide easily along the stripper surface 65 during the stripping process. The impact energy dissipated at the bucket slot end DE associated with a signature collision with surface DE is less than 70% of the total impact energy dissipated by the signature 30 as it is brought to a stop at the end of the printing process. The impact energy of a signature collision with the stripper is greater than 30% of the total impact energy. The stripper surface 65 is also rounded along its two side edges to prevent signature damage.

The delivery apparatus of the present invention organizes a separated stream of signatures into a shingled stream of signatures and preferably includes at least 10 blades and no more than 14 blades, and even more preferably includes 12 blades. In addition, the inner end slots on the bucket define an inner circle having a diameter that preferably is at least 24 inches and no more than 30 inches, and even more preferably is 27 inches. The tips of the blades on the buckets define an outer circle having a diameter that is preferably at least 32 inches and no more than 40 inches, and even more preferably is 37.5 inches.

Various features and advantages of the invention are set forth in the following claims.

What is claimed is:

1. A delivery apparatus for organizing a separated stream of signatures into a shingled stream of signatures, the apparatus comprising:

a bucket operable to rotate around an axis, the bucket including at least 10 blades and no more than 14 blades with tips that define an outer circle having a diameter of at least 32 inches and no more than 40 inches, wherein a primary surface of a leading blade together with a secondary surface of a successive blade define a slot adapted to receive and slow down signatures, the slots including inner ends defining an inner circle having a diameter that is at least 24 inches.

2. The delivery apparatus of claim 1 further comprising a second bucket that includes a plurality of blades having tips that define an outer circumference, wherein the second bucket is disposed adjacent to the other bucket such that the outer circle of one bucket overlaps the outer circumference of the other bucket.

3. The delivery apparatus of claim 1, wherein the diameter of the outer circle is 37.5 inches.

4. The delivery apparatus of claim 1, wherein the diameter of the inner circle is no more than 30 inches.

5. The delivery apparatus of claim 1, wherein the diameter of the inner circle is 27 inches.

6. The delivery apparatus of claim 1, wherein the bucket includes 11 blades.

7. A delivery apparatus for organizing a separated stream of signatures into a shingled stream of signatures, the apparatus comprising:

a bucket including at least 10 blades and no more than 14 blades, the blades including tips that define an outer circle having a diameter of at least 32 inches, wherein a primary surface of a leading blade together with a secondary surface of a successive blade define a slot adapted to receive and slow down signatures, the slots including inner ends defining an inner circle having a diameter that is at least 24 inches and no more than 30 inches.

8. The delivery apparatus of claim 7, wherein the diameter of the outer circle is no more than 40 inches.

9. The delivery apparatus of claim 8, wherein the diameter of the outer circle is 37.5 inches.

10. The delivery apparatus of claim 7, wherein the bucket includes twelve blades.

11. The delivery apparatus of claim 7 further comprising a second bucket that includes a plurality of blades having tips that define an outer circle, wherein the second bucket is disposed adjacent to the other bucket such that the outer circle of the second bucket overlaps the outer circle of the other bucket.

12. The delivery apparatus of claim 7, wherein the diameter of the inner circle is 27 inches.

13. A delivery apparatus for organizing a separated stream of signatures into a shingled stream of signatures, the apparatus comprising:

a bucket including at least 10 blades, the blades including tips that define an outer circle having a diameter of at least 32 inches and no more than 40 inches, wherein a primary surface of a leading blade together with a secondary surface of a successive blade define a slot adapted to receive and slow down signatures, the slots including inner ends defining an inner circle having a diameter that is at least 24 inches and no more than 30 inches.

14. The delivery apparatus of claim 13, wherein the bucket includes no more than 14 blades.

15. The delivery apparatus of claim 14, wherein the bucket includes 12 blades.

16. The delivery apparatus of claim 13, wherein the diameter of the inner circle is 27 inches.

17. The delivery apparatus of claim 13, wherein the diameter of the outer circle is 37.5 inches.

18. A delivery apparatus for organizing a separated stream of signatures into a shingled stream of signatures, the apparatus comprising:

a bucket including at least 10 blades and no more than 14 blades, the blades including tips that define an outer circle having a diameter of at least 32 inches and no more than 40 inches, wherein a primary surface of a leading blade together with a secondary surface of a successive blade define a slot adapted to receive and slow down signatures, the slots including inner ends defining an inner circle having a diameter that is at least 24 inches and no more than 30 inches.

19. The delivery apparatus of claim 18, wherein the diameter of the inner circle is 27 inches.

20. The delivery apparatus of claim 18, wherein the bucket includes 12 blades.

21. The delivery apparatus of claim 18, wherein the diameter of the outer circle is 37.5 inches.

22. A method for decelerating signatures delivered to a rotating delivery bucket, the method comprising:

selecting a desired signature delivery velocity;

determining a kinetic energy of an individual signature at the desired signature delivery speed;

selecting an intermediate signature velocity that reduces the kinetic energy of the individual signature by between about 20 and 40 percent;

providing a delivery bucket including a plurality of blades defining slots therebetween, each slot adapted to receive one individual signature and having slot ends defining an inner diameter;

selecting a desired rotational velocity of the delivery bucket;

selecting the inner diameter such that a tangential velocity of the slot ends is substantially equal to the selected intermediate signature speed when the delivery bucket is rotated at the desired rotational velocity; and delivering signatures to the rotating delivery bucket at the signature delivery velocity.

* * * * *

UNITED STATES PATENT AND TRADEMARK OFFICE

CERTIFICATE OF CORRECTION

PATENT NO. : 6,419,219 B2
DATED : July 16, 2002
INVENTOR(S) : Karl P. Schaefer et al.

It is certified that error appears in the above-identified patent and that said Letters Patent is hereby corrected as shown below:

Column 7,
Line 38, delete "11" and insert -- 12 --.

Signed and Sealed this

Eighth Day of April, 2003

JAMES E. ROGAN
*Director of the United States Patent and Trademark Office*